United States Patent [19]

McMillin et al.

[11] Patent Number: 4,765,513

[45] Date of Patent: Aug. 23, 1988

[54] POST-MIX BEVERAGE DISPENSER WITH NOZZLE

[75] Inventors: John R. McMillin, Maplewood; Herman S. Fessler, Coon Rapids, both of Minn.

[73] Assignee: The Cornelius Company, Anoka, Minn.

[21] Appl. No.: 50,830

[22] Filed: May 15, 1987

Related U.S. Application Data

[63] Continuation-in-part of Ser. No. 769,239, Aug. 26, 1985, abandoned.

[51] Int. Cl.[4] ..... B67D 5/56

[52] U.S. Cl. ..... 222/129.1; 222/148; 222/506; 251/282; 239/113

[58] Field of Search ..... 222/129.1–129.4, 222/148, 135, 505, 506; 137/237; 251/282; 239/112, 113; 134/169 R, 169 C

[56] References Cited

U.S. PATENT DOCUMENTS

| | | | |
|---|---|---|---|
| 3,192,952 | 7/1965 | Botnik | 251/282 X |
| 3,731,845 | 5/1973 | Booth | 222/129.1 |
| 3,898,861 | 8/1975 | McMillin | 222/148 X |
| 3,902,636 | 9/1975 | Zilk | 222/129.1 |
| 4,194,650 | 3/1980 | Nottke et al. | 222/148 X |
| 4,316,557 | 2/1982 | Benoun et al. | 222/129.1 |
| 4,478,357 | 10/1984 | Jenkins | 222/129.1 X |
| 4,496,079 | 1/1985 | Verley | 222/129.1 |
| 4,549,675 | 10/1985 | Austin | 222/129.1 |
| 4,552,286 | 11/1985 | Kuckens et al. | 239/113 X |
| 4,582,226 | 4/1986 | Doak | 222/148 |

FOREIGN PATENT DOCUMENTS

| | | | |
|---|---|---|---|
| 1066675 | 11/1979 | Canada | 222/148 |

*Primary Examiner*—F. J. Bartuska
*Assistant Examiner*—Gregory L. Huson
*Attorney, Agent, or Firm*—Henry C. Kovar

[57] ABSTRACT

A post-mix beverage dispensing system has a structure for flushing the dispensing valve and its nozzle of syrup using diluent water from the water supply; the dispensing valve has a nozzle, syrup and water valves and an actuator for the syrup and water valves, a mounting block for the dispensing valve has water and syrup ports with inlets and outlets and normally closed disconnect valves in the outlet enabling removal of the dispensing valve from the block, a flush connector goes across the bottom of the block and is fluidly connected into the water and syrup ports, a normally closed flush valve is in the connector and has an external pushbutton actuator for opening the valve for connecting the water port to the syrup port to flush the syrup port disconnect valve, flow control, syrup valve and nozzle with water, and there is structure to prevent flow of flush water into the syrup supply line. A method of flushing a post-mix valve has the steps of connecting the water line to the syrup line and flushing the syrup valve and nozzle with water from the beverage water supply. An alternative flush valve has structure for neutralizing the syrup pressure so that syrup pressure cannot open the flush valve if and when water pressure drops, and a lever type flush actuator behind the dispensing actuator lever enables easy flushing by squeezing the two levers together with the thumb and finger of one hand.

33 Claims, 3 Drawing Sheets

POST-MIX BEVERAGE DISPENSER WITH NOZZLE

RELATED APPLICATIONS

This is a co-pending continuation-in-part of U.S. Ser. No. 769,239 filed on Aug. 26, 1985, and now abandoned.

BACKGROUND OF THE INVENTION

1. Field of the Invention

This invention pertains to an economical and effective method of and apparatus for flushing beverage syrup from a post-mix beverage dispensing valve, using water from the beverage water supply.

2. The Prior Art

Post-mix beverages are the normal form of beverage dispensed into a cup at fast food retailers. A beverage concentrate or syrup is provided to the retailer for soft drinks, tea, coffee, juice and the like. The retailer has a dispensing valve that mixes one part of syrup with several parts of water to make a finished drink for the consumer. A typical soft drink has one part of syrup dispensed and mixed into five parts of carbonated water.

Sanitation has not been a problem with post-mix soft drinks because the syrups have not degraded or been biologically active when left in the dispensing valves. Mechanical sanitation shields have been used to keep flies and insects out of the nozzles during use and periods of non-use. These shields have been of limited success and are disliked by the retailers and do not see common use. Dried syrup residue does build up inside of the nozzle and attracts insects and rodents, and little or nothing has been done about it because the health agencies have more or less been unable to devise an effective correction of the problem.

A new form of beverage is being offered and is preferred by the consumer that is intensifying the need for a method and structure to economically and easily clean post-mix dispensing valves. This new beverage is the soft drink having real juice in it. For example, a lemon-lime soft drink with 10 percent real juice is currently available. Orange flavor beverages with 5–15 percent real orange juice are being tested. These beverages offer a significant opportunity for the citrus industry and are a healthful and positive development for new popular beverage with nutritional value. It is expected that the consuming public will become enamoured of these beverage blends with real juice and that 50 percent blends will eventually become preferred and available in the market place.

Existing soft drink equipment is unable to guarantee sanitary dispensing and correct flavor of these beverages. The syrups for these beverages can spoil in the dispensing valve and nozzle and contaminate the dispensing valve and give off-taste as well as be biologically contaminated and very unsightly.

There are several successful post-mix dispensing valves being utilized. Specific examples are offered by The Cornelius Company, Alco Standard, McCann Engineering, Booth, Flomatic, and Concession Services. None of the commercialized dispensing valves and systems have an economically effective method or structure for cleaning and flushing of syrup from the valve.

OBJECTS OF THE INVENTION

It is an object of the present invention to provide an improved post-mix beverage dispensing system having a new structure for easily, economically and effectively flushing syrup from the dispensing valve and nozzle for cleaning and sanitation and for assuring beverage flavor and cleanliness of the highest quality.

It is an object of the present invention to provide a method of flushing syrup from a post-mix beverage dispensing valve and nozzle that is effective, economical, and which will be used to help provide consumers with the highest quality of flavor of beverages.

It is an object of the present invention to provide an improved poxt-mix beverage dispensing valve having new economical and effective structure for flushing syrup out of the syrup valve and the nozzle.

It is an object of the present invention to provide an improved mounting block for a post-mix beverage dispensing valve, the block having structure for flushing syrup from a disconnect valve in the block as well as the syrup valve and nozzle of the dispensing valve.

It is an object of the present invention to provide a new flushing valve for a post-mix beverage dispensing head.

It is an object of the present invention to provide a flush valve on a post-mix beverage dispenser wherein a discrete lever activates the flush valve.

It is an object of the present invention to provide an improved flush valve for a post-mix beverage dispenser, wherein pressurized syrup cannot open the flush valve.

These and other objects of the present invention will become manifest to those versed in the art upon review of the teachings herein and upon use of the invention described and claimed herein.

SUMMARY OF THE INVENTION

According to the principles of the present invention, a post-mix beverage dispensing system has a dispensing valve with a nozzle, a water line leading to a normally closed water valve, a syrup line leading to a normally closed syrup valve, a nozzle at the end of the lines, flush structure for connecting the water line to the syrup line upstream of both valves, a normally closed valve in the connecting structure, structure for preventing reverse flow of syrup, and an actuator for opening the connecting valve to flush the syrup valve and nozzle with water from the beverage water supply.

A method of flushing a post-mix beverage dispensing system of syrup has the steps of opening water and syrup dispensing valves, connecting a water line to a syrup line upstream of the syrup valve, blowing out all syrup between the connection and a nozzle, flushing the syrup dispensing valve and nozzle with a further flow of flushing water taken from a supply of water for dispensing, and disconnecting the water line from the syrup line so that syrup can again be supplied to the syrup dispensing valve and nozzle.

A beverage dispensing valve has a body with a nozzle, water line, syrup line, water and syrup valves and a dispensing actuator, flush structure upstream of the water and syrup valves for connecting the water line to the syrup line, a normally closed flush valve in the connecting structure, and a discrete flushing actuator for opening the flush valve and fluidly connecting the water line into the syrup line.

A mounting block for a post-mix beverage dispensing valve has a body with water and syrup ports, a self-closing disconnect valve in an outlet of each port, a flushing connector connected into the water and syrup ports upstream of the disconnect valves, a flush valve normally closing the connector, and a flush valve actuator for opening the flush valve and connecting the water port to the syrup port through the connector.

A flush valve for a post-mix beverage dispensing valve has a connector body with a port for connecting the water and syrup lines, a normally closed flush valve in the port, a lever fulcrum on the body, and a flush actuator lever pivotally mounted on the fulcrum.

A flush valve for a post-mix beverage dispensing valve has a connector body with a port for connection of water and syrup lines, a normally closed valve in the port, an outside actuator for operation of the normally closed valve, the valve member is an elastomeric ring seated on a narrow annular seat, and the valve has a sealed stem for hydraulically neutralizing the syrup pressure.

DESCRIPTION OF THE PREFERRED EMBODIMENT

Figure 1:
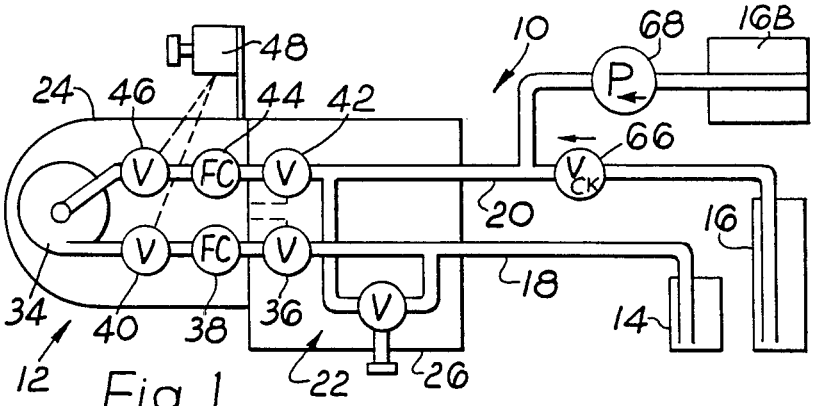
FIG. 1 is a schematic of the preferred embodiment of the post-mix beverage dispensing system of the present invention.
Figure 2:
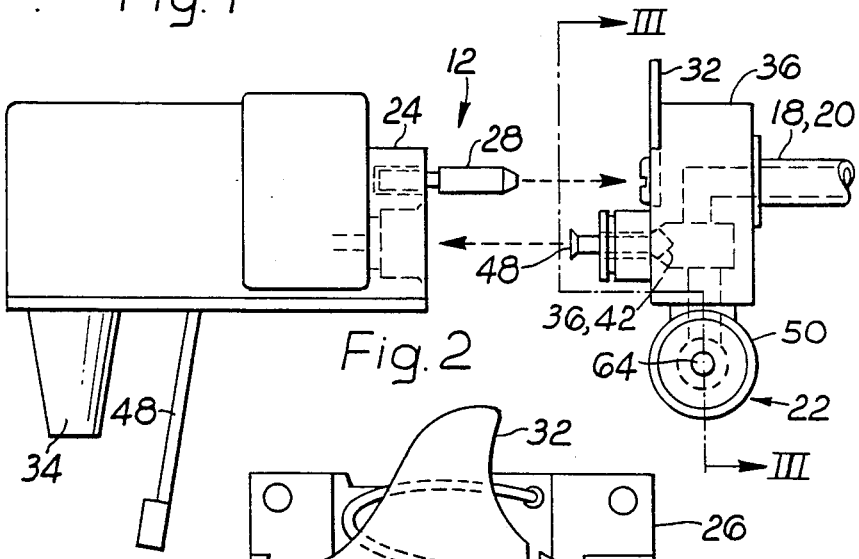
FIG. 2 is an elevational side view of the preferred embodiment of the post-mix dispensing valve of the present invention.

According to the principles of the present invention, a post-mix beverage dispensing system is schematically illustrated in FIG. 1 and generally indicated by the numeral 10. The system 10 has a complete post-mix dispensing valve generally indicated by the numeral 12, a source of dispensing water 14, a source of syrup 16, a water line 18, a syrup line 20, and flushing structure for connecting the water line to the syrup line 20, which flushing structure is generally indicated by the numeral 22.

The complete dispensing valve 12 has a valve body 24 detachably mounted to a mounting block 26. The block 26 is securely mounted on and fastened to a dispensing machine (not shown) and the body 24 and block 26 are secured and locked to each other by a lock pin 28 on the body 24 which fits into a lock bore 30 and is locked by a lock latch 32 which may be spring loaded as shown. The water and syrup lines 18, 20, extend from the sources 14, 16, and through the block 22 to a dispensing nozzle 34. The nozzle 34 may be the type of nozzle shown in U.S. Pat. No. 4,509,690. The water line 18 has a normally closed disconnect valve 36 in the block 26, and a flow control 38 and a normally closed water dispensing valve 40 in the body 24. The syrup line 16 has a normally closed disconnect valve 42 in the block 26 and a flow control 44 and normally closed syrup dispensing valve 46 in the body 24. A dispensing actuator 48 which may be a lever or a button on an electronic control is provided with the body 24 and is connected to concurrently open both water and syrup dispensing valves 40, 46. Each of the disconnect valves 36, 42 is a poppet style valve having a stem 48 which is engaged and pushed in by the body 24 to open the disconnect valves 36, 42 when the body 24 is locked to the block 26. The disconnect valves 36, 42 automatically close when the body 24 is removed from the block 26. This particular preferred dispensing valve 12 is the subject of and is completely explained in Forrest A. Austin co-pending application Ser. No. 415,505 of Sept. 7, 1982 assigned to a common assignee and now U.S. Pat. No. 4,549,675, and of subsequent co-pending and commonly owned divisional applications. Reference is made to these applications for a more detailed description of the structures and functions of the complete dispensing valve 12.

Figure 3:
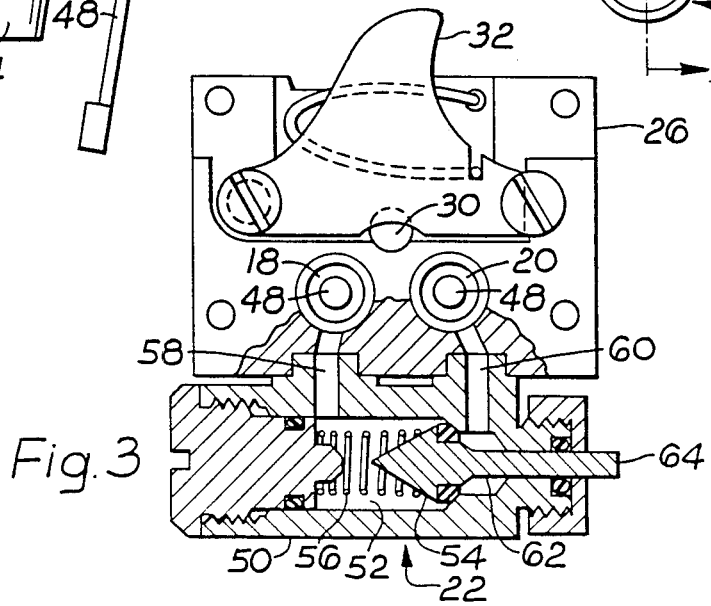
FIG. 3 is an elevational view of the preferred embodiment of the mounting block in and for the dispensing valve of FIG. 2 and of the present invention, taken through lines III—III of FIG. 2.

The important feature in the present invention is the flushing structure 22 in the system 10, in the dispensing valve 12, and in the mounting block 26, as well as its usage in the practice of the method of the present invention. The flushing structure 22 has a flushing connector 50 mounted transversely underneath and to the bottom of the block 26. The connector 50 has an internal fluid connector flush port 52 which fluidly connects to the water line 18 and the syrup line 20 upstream of the disconnect valves 36, 42. The flush port 52 is normally closed by a poppet type flush valve 54 having its head facing the water line 18 so that water supply pressure biases the flush valve 54 closed. Note that the FIG. 3 view shows a reversal of water and syrup lines from FIG. 1, specifically in FIG. 3 the water line 18 is on the left and in FIG. 1 the water line is on the right if FIG. 1 is a top view. The water and syrup lines 18, 20 can be on either side and the connector 50 can be as shown or reversed if need be. A closing spring 56 on the upstream side of the flush valve 54 and in the flush port 52 biases the flush valve 54 closed. The flush port inlet 58 comes from the water line 18 and the flush port outlet 60 goes into the syrup line 20. The flush valve 54 has a transversely extending stem 62 with a pushbutton end 64 that is manually depressible to open the flush valve 54 and fluidly connect the water line 18 to the syrup line 20 through the flush port 52. The connector 50 and pushbutton 64 are under the block 26 and cannot be seen from above the dispensing valve 12 and they are generally positioned out of the way where they do not intrude and they do not interfere with cup placement under the nozzle 34 on electronic dispensing valves 12 because the connector 50 at its lowest point is above the lowest level of the bottom of the nozzle 34. The flush valve 54 is stable only in the closed position so that it cannot accidentally be left open.

The syrup line 20 if it is connected to the syrup tank 16 has a check valve 66 for precluding reverse flow of syrup in the syrup line 20. If a tank 16 is not used, a bag-in-box 16B or non-pressurized syrup bottle may be used with a positive displacement syrup pump 68. The pump 68 will present reverse flow of syrup in the syrup line 20.

In the use and operation of the system 10, dispensing valve 12 and mounting block 26, and in the practice of the method of the present invention, the water source 14 is typically a carbonator and is at a higher propellant pressure than the syrup source 16. The mounting block 26 is fixed on a dispenser (not shown). This mounting block 26 can be retrofitted to existing beverage dispensers to upgrade the sanitation and cleanliness of existing dispensing worldwide. The flush valve 54 is closed and the valve body 24 is mounted on the block 26. The dispensing actuator 48 is manipulated and both the water and syrup dispensing valves 40, 46 are opened and syrup and water both flow in lines 18, 20 respectively to and through the nozzle 34. To flush the dispensing valve 12, the pushbutton 64 is depressed and the flush valve 54 is opened at the same time the water and syrup dispensing valves 40, 46 are open. The water line 18 is then fluidly connected to the syrup line 20 upstream of the syrup disconnect valve 42. The water pressure is greater than the syrup pressure so syrup flow is stopped and water from the water supply 14 is propelled into the syrup line 20 forcing and flushing all syrup from the syrup disconnect valve 42, the syrup flow control 44, the syrup dispensing valve 46, and the nozzle 34. A subsequent and further flow of water completely flushes and cleans these syrup components 42, 44, 46 and 34 and the dispensing actuator 48 is released and the water and syrup dispensing valves 40, 46 are closed while the flush valve 54 is left open. The check valve 66 or pump 68 precludes reverse flow of syrup or flush water in the syrup line 20. The flush valve 54 is then released and the water line 18 is fluidly disconnected from the syrup line 20, and the flushing is complete. The valve body 24 may then be removed from the block 26 while the lines 18, 20 both remain pressurized and the body 24 is completely devoid of and cleaned of syrup, likewise the syrup disconnect valve 42 so there is no syrup to drip or to mess up, or to attract insects or rodents. When the dispensing valve is next used for dispensing, syrup forces out any and all flush water left in the syrup line 20 and components 42, 44, 46, 34.

Figure 4:
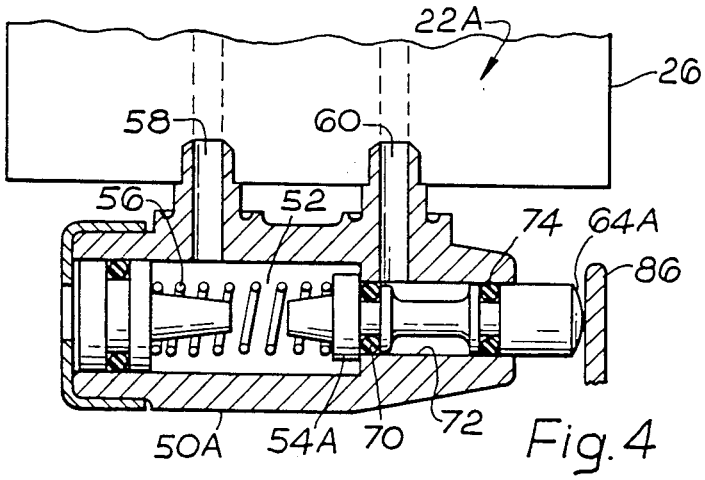
FIG. 4 is an elevational cross-sectional view through an alternative and improved flushing valve on a post-mix beverage dispensing valve.
Figure 5:
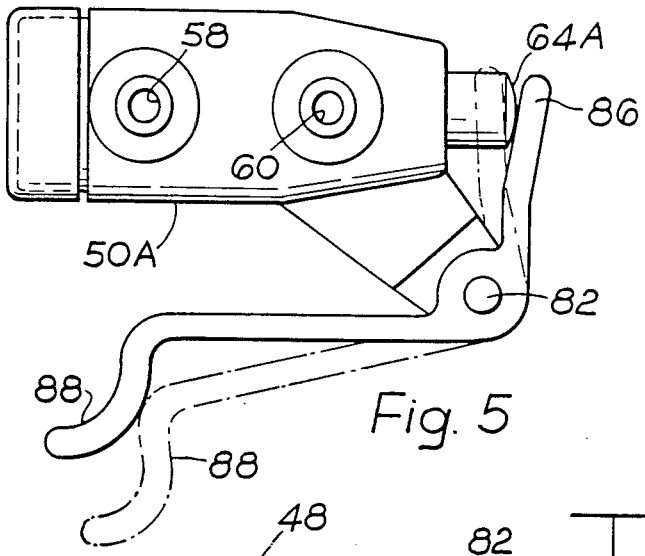
FIG. 5 is a top plan view of FIG. 4.
Figure 6:
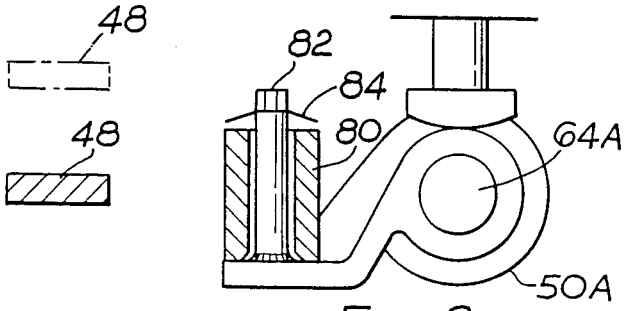
FIG. 6 is an end elevational view of FIG. 4.

In the improvement of FIGS. 4–6, a new type of valve element and a new actuator are shown. It has been found that in the embodiment of FIG. 3, when the carbon dioxide bottle of the soft drink system becomes empty, the pressure of the carbonated water drops significantly while the pressure of syrup does not drop. Those experienced in soft drinks systems will realize that as the water flows through the carbonator and to the dispensing valve 12, that the water consumes the carbon dioxide gas. Whereas, the carbon dioxide gas applied on syrup in a syrup tank is not consumed and the syrup remains at close to its pre-set pressure. It has been found that the pressurized syrup can force the poppet valve 54 of FIG. 3 open when the water pressure drops. This is not desirable.

The flushing structure 22A of FIGS. 4–6 has a generally similar connector body 50A with a flush port 52, water inlet 58 and outlet 60. The alternative flush valve 54A is different and is a spool valve having a shut-off or valving o-ring 70 which seals and seats in a stem bore 72 to normally close the passageway 52 from the inlet 58 to the outlet 60 and also the outlet 60 from the inlet 58. An outside syrup seal ring 74 is also sealed to the stem bore 72 so that syrup cannot leak out of the body 50A. The two seal rings 70, 74 are of the same diameter and effectively neutralize the syrup pressure upon the valve 54A so that normally encountered syrup pressures cannot move the valve 54A nor open the valve 54A. Only a force upon the valve pushbutton 64A will open the valve 54A and there is no possibility of cross flow of syrup. The normal water pressure tends to bias the valve 54A closed.

Figure 7:
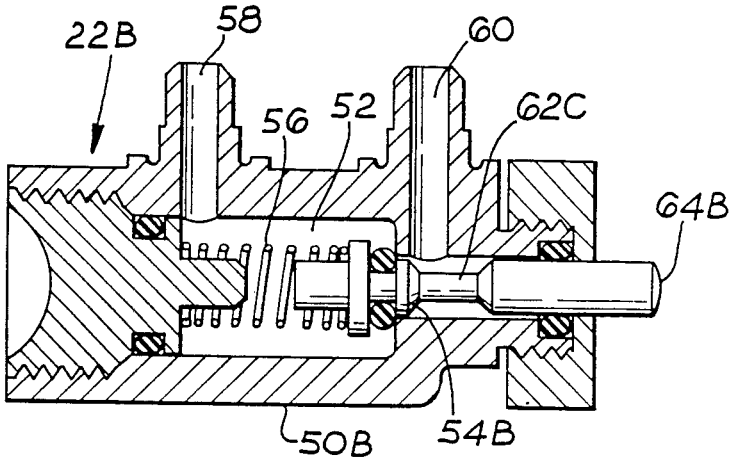
FIG. 7 is an elevational cross-sectional view through a second alternative and improved flushing valve in a post-mix beverage dispensing valve.
Figure 8:
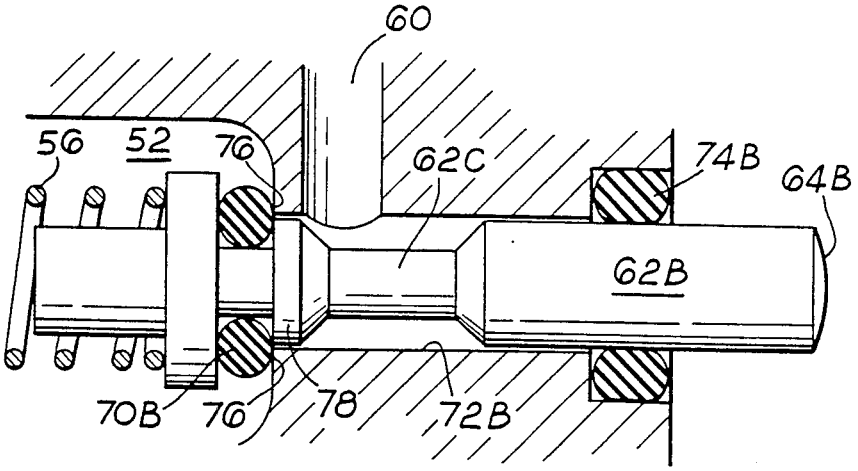
FIG. 8 is a detail view of the flush valve in FIG. 7.

In the further alternative improved dispensing valve flushing structure 22B of FIGS. 7 and 8, a slightly different connector body 50B is utilized. This body 50B also has an inlet 58, outlet 60 and stem bore 72B. In this embodiment, the body 50B and port 52 have an annular valve seat 76 which faces toward the water inlet 58 and which has an internal diameter equal to the diameter of the stem bore 72B. The actual valve element is an elastomeric o-ring 70B which has its mean diameter abutted against the annular valve seat 76. The mean diameter of the o-ring 70B is substantially identical to the diameter of the stem bore 72B and the internal diameter of the seat 76. The valve element 54B has a ring back up flange 78 that is a slip fit in the stem bore 72B. The valve stem 62B is also effectively sealed by the outer syrup seal ring 74B at substantially the same diameter as the inside diameter of the valve seat 76. The gap between the flange 78 and the stem bore 72B is an annular gap of about 0.005 inches (0.25 mm) wide and the areas of the valve seat 76 and the stem seal 74B are closely matched so that no normal syrup pressure can open the valve 54B. This particular valve 54B is extremely fast opening, does not require a pilot, and can be used again and again without danger of cutting or slicing the o-ring 70B.

A flush valve actuator lever 80 that may be utilized upon any of the flush connectors 50, 50A, 50B is shown on the flush connector 50A of FIGS. 4–6. A pin forming a fulcrum 82 is fixed to the body of the flush connector 50A and therefore to the mounting block 26. The flush lever 80 is rotatably mounted upon the fulcrum 82 and may be retained by a fastener 84. The flush lever 80 has a work end 86 which engages the flush valve pushbutton 64A and a handle end having a trigger 88. The fulcrum 82 is parallel to the inlet 58 and outlet 60 and the lever 80 rotates about an axis parallel to the inlet 58 and outlet 60. The lever 80 is mounted very close to the flush connector 50A and is directly underneath the valve body 24 and mounting block 26. The trigger end 88 is behind and spaced rearward of the dispensing actuation lever 48, and is positioned alongside and in front of the body of the flush connector 50A. When the valve body 24 is disconnected from the mounting block 26, the flush lever 80 remains with the mounting block 26.

The operation is considerably improved and the device is also now much easier to use. The operator or user of the improved dispensing system 10 merely takes one hand and puts his or her first finger behind the trigger end 88 and his or her thumb in front of the dispensing actuation lever 48 and merely squeezes the two levers 80, 48 together to the alternative positions shown in dotted lines in FIG. 5. The flush lever 80 has more resistance than the dispensing lever 48 when the levers 48, 80 are released, and the dispensing actuator lever 48 returns first and the water and syrup valves 40, 46 close before the flush valve 54. 40, 46 close before the flush valve 54.

This operation is extremely easy and quick. It is very difficult to comprehend anything more effective from the multiple perspective of sanitation, ease of operation, cost effectiveness, retro-fit, usefulness, acceptability by the soft drink companies and retailers and customers and health agencies, and in many other not-yet realized aspects.

This method and device are very fast, are easy to use, and are economical. It takes only a few seconds to flush and clean each dispensing valve 12 and a system of 4, 5 or 6 valves can be completely flushed and cleaned in less than a minute. The retailer can easily and economically now flush and clean the entire dispensing system 10 at the conclusion of business each day, in the morning before the start of the business day, and after each peak business session. This method and device are extremely easy to use, and therefore will actually be used and will be commercially effective in improving the quality and flavor of beverages, in significantly decreasing contamination from insects and rodents, and improve the sanitation and cleanliness of beverages served in cups. This method and apparatus is particularly useful with the new healthful and nutritious beverages containing natural juices or which do not have preservatives. This method and apparatus are also extremely effective for either random or repetitious cleaning of the syrup flow control 44 so that a correct ratio of syrup to water is maintained.

Although various minor modifications may be suggested by those versed and experienced in the art, be it understood that we wish to embody within the scope of the patent warranted hereon all such embodiments as reasonably and properly come within the scope of our contributions to the art.

We claim as our invention:

1. A method of flushing at least part of the syrup components in a post-mix carbonated beverage dispensing system with carbonated water comprising the steps of:

a. concurrently opening a syrup dispensing valve and carbonated water valve in a pressurized syrup line and pressurized carbonated water line respectively, both lines leading through a respective discrete opened disconnect valve to a dispensing nozzle;
b. selectively and intermittently connecting the carbonated water line to the syrup line at a connecting point upstream of the syrup disconnect valve by opening a normally closed flush valve;
c. precluding reverse flow of syrup in the syrup line by checking against reverse syrup flow upstream of the connection point;
d. propelling all syrup from the connection point to the nozzle out of the nozzle with a displacing flow of carbonated flushing water from the carbonated water line via the connection point;
e. flushing the syrup disconnect valve, syrup dispensing valve, and the nozzle with a further flow of the carbonated flushing water;
f. concurrently flushing a syrup flow control in the syrup line with the carbonated flush water;
g. concurrently flushing a disconnect valve in the syrup line and between a valve body and mounting block, with the carbonated flush water;
h. disconnecting the carbonated water line from the syrup line by closing the flush valve so that syrup can again be supplied to the nozzle, said nozzle, syrup dispensing valve, syrup flow control, and syrup disconnect valve having been completely flushed of syrup and cleaned with carbonated water from the carbonated water supply line;
i. neutralizing syrup pressure upon the normally closed flush valve so that if and when syrup pressure exceeds the carbonated water pressure the syrup pressure cannot open the flush valve; and
j. discretely operating a discrete and dedicated mechanical flush actuator on the dispensing valve, said flush actuator being mechanically connected to said flush valve for mechanical operation of said flush valve in response to manual and mechanical operation of the flush actuator.

2. A method of flushing a post-mix beverage dispensing system comprising the steps of:

(a) concurrently opening a syrup valve and water valve in a syrup line and water line respectively, both lines leading to a dispensing nozzle;
(b) connecting the water line to the syrup line at a connecting point upstream of the syrup valve;
(c) operating a discrete flush lever underneath the dispensing valve to connect the water and syrup lines by squeezing the flush lever and a dispensing lever together with the thumb and a finger of one hand, to connect the water and syrup lines;
(d) precluding reverse flow of syrup in the syrup line;
(e) propelling all syrup from the connection point to the nozzle out of the nozzle with a flow of flushing water from the water line via the connection point;
(f) flushing the syrup valve and nozzle with a further flow of the flushing water; and
(g) then disconnecting the water line from the syrup line so that syrup can again be supplied to the nozzle, which has just been flushed and cleaned with water from the water supply line, by releasing the squeeze upon the flush and dispensing levers.

3. A mounting block for a post-mix carbonated beverage dispensing valve mounting block, comprising (a) a block body having means for being mounted to the exterior of a beverage dispenser, a water port having a water inlet extending to a water outlet, and a syrup port having a syrup inlet extending to a syrup outlet, the water port and syrup port being fluidly discrete from each other;
(b) a disconnect valve in each of the outlets, each disconnect valve having means for being opened upon connection and locking of a dispensing valve body to the block;
(c) lock means on the block for quick disconnect locking retention of the valve body to the block;
(d) a flushing connector fluidly connected into the water port and into the syrup port in between respective disconnect valves and the inlets;
(e) a flush valve normally closing the connector;
(f) a flush valve actuator for opening the flush valve and fluidly connecting the water port to the syrup port through the flushing connector, said flush valve actuator being a discrete and dedicated flush actuator lever movably mounted to and dependent from said block, said flush lever remaining with said block during both installation and removal of the dispensing valve body to and from the block, said flush actuator being operable independently of any actuators or valves in said body.

4. A beverage dispensing valve comprising (a) a valve body having a nozzle, a water line, a syrup line, a normally closed water valve in the water line, a normally closed syrup valve in the syrup port, and a dispensing actuator for opening both the water and syrup valves concurrently;
(b) means upstream of the water and syrup valves and in between the water and syrup lines for fluidly connecting the water line to the syrup line;
(c) a normally closed flush valve in said connecting means for normally fluidly closing said connecting means;
(d) a discrete flushing actuator for opening the normally closed flush valve for direct fluid connection of the water line to the syrup line, said flushing actuator being a discrete lever adjacent to the valve body and independent of the dispensing actuator, with both actuators being concurrently operable; and in (e) which said dispensing actuator is a discrete lever depending downwardly from the valve body, said flush actuator lever and said dispensing actuator lever being squeezeable together for flushing the dispensing valve.

5. The dispensing valve of claim 4, in which the flush lever is behind the dispensing lever.

6. A flush valve for a post-mix carbonated beverage dispensing valve, comprising (a) a flush connector body having a flush fluid port there through, a fluid inlet to the flush port, a fluid outlet from the flush port, means for fluid connection of the inlet to a water line of the dispensing valve, and means for fluid connection of the outlet to a syrup line of the dispensing valve, and a valve seat in the port in between the inlet and outlet, (b) a flush valve in the port, said flush valve having a valve member normally closing the seat and a stem extending to outside of the connector body through a first end of the body;

(c) a plug which is mounted in and is fluid tightly closing a second end of the body;

(d) a spring biasing the flush valve closed;

(e) a lever fulcrum on the exterior of the connector body; and (f) a flush actuator lever pivotally mounted on the fulcrum and having a first work end engaging the valve stem and a second handle end manipulatable by a finger for opening of the flush valve.

7. The flush valve of claim 6, in which the fulcrum is a pin having an axis parallel to axis of the flush port inlet and outlet, and the lever is actuatable in a plane perpendicular to the flush port inlet and outlet axis.

8. The flush valve of claim 7, in which the lever has its handle end alongside the connector body.

9. A flush valve for a post-mix carbonated beverage dispensing valve, comprising (a) a flush connector body having a flush fluid port there through, a fluid inlet to the flush port, a fluid outlet from the flush port, means for fluid connection of the inlet to a water line of the dispensing valve, and means for fluid connection of the outlet to a syrup line of the dispensing valve, and a valve seat in the port in between the inlet and outlet, said seat facing towards the inlet;

(b) a flush valve in the port, said flush valve having a valve member normally closing the seat and a stem extending to outside of the connector body through a first end of the body;

(c) a plug which is mounted in and is fluid tightly closing a second end of the body;

(d) a spring biasing the flush valve closed;

(e) means outside of the connector body for operation of the flush valve to open the seat;

(f) said valve member comprising an elastomeric ring fixed on and co-movable with the stem, said ring having a relatively narrow annular sealing face seated against said valve seat; and (g) means in said stem and said port for hydraulically neutralizing pressure in the outlet port upon the valve so that normally encountered syrup pressures applied through the outlet port cannot open the valve.

10. The flush valve of claim 9, in which the ring is an o-ring, and in which the o-ring is seated upon its mean diameter in a narrow annular contact against the valve seat.

11. The flush valve of claim 10, in which the internal diameter of the valve seat and an outer diameter of a syrup side back up flange on the valve are both substantially the same as the mean diameter of the o-ring, the flange being a slip fit in the seat.

12. A method of flushing at least part of the syrup components of a carbonated beverage dispensing valve in a post-mix carbonated beverage dispensing system with carbonated water, said dispensing valve having a mounting block affixed on a dispenser and a separable valve body locked to the mounting block, comprising the steps of:

a. concurrently opening a syrup dispensing valve and carbonated water valve in a pressurized syrup line and pressurized carbonated water line respectively, both lines leading from sources of syrup and carbonated water respectively through a respective discrete opened disconnect valve to a dispensing nozzle;

b. selectively and intermittently connecting the carbonated water line to the syrup line at a connecting point in said dispensing valve and upstream of the syrup disconnect valve by manually and mechanically opening a normally closed discrete flush valve in said dispensing valve;

c. precluding reverse flow of syrup in the syrup line by checking against reverse syrup flow upstream of the connection point;

d. propelling all syrup from the connection point to the nozzle out of the nozzle with a displacing flow of carbonated flushing water from the carbonated water line via the connection point;

e. flushing the syrup dispensing valve and the nozzle with a further flow of the carbonated flushing water;

f. concurrently flushing a syrup flow control in the dispensing valve with the carbonated flush water;

g. concurrently flushing said syrup disconnect valve in the syrup line and between said valve body and said mounting block, with the carbonated flush water;

h. then disconnecting the carbonated water line from the syrup line by closing the flush valve so that syrup can again be supplied to the nozzle, said nozzle, syrup dispensing valve, syrup flow control, and syrup disconnect valve having been completely flushed of syrup and cleaned with carbonated water from the carbonated water supply line with said valve body being devoid of syrup after flushing; and i. neutralizing syrup pressure upon the normally closed flush valve so that if and when syrup pressure exceeds the carbonated water pressure the syrup pressure cannot open the flush valve.

13. A method according to claim 12, including the step of biasing the flushing valve closed with the water.

14. A method according to claim 12, including the further step of disconnecting and removing a discrete said dispensing valve body from a discrete said mounting block of the flushed and cleaned valve, with the valve body and syrup disconnect valve both being flushed of syrup and with the mounting block remaining pressurized with both carbonated water and syrup.

15. A post-mix beverage dispensing system comprising (a) a dispensing valve having a nozzle, a normally closed syrup valve, a normally closed water valve, and a dispensing actuator for concurrently opening both values;

(b) a syrup line extending from a syrup supply to the nozzle, said line extending through the syrup valve, and a water line extending from a water supply to the nozzle, said water line extending through the water valve;

(c) connecting means between the water and syrup lines for fluidly connecting the water line to the syrup line upstream of both valves;

(d) a normally closed flush valve in said connecting means for normally closing said connecting means;

(e) means in said syrup line and upstream of said connecting means for preventing reverse flow of syrup in the syrup line;

(f) a flush actuator for opening the flush valve, said flush valve being openable concurrently with the syrup and water valve so that a normal flow of syrup to and through the nozzle is replaced by a flow of flush water for flushing all syrup from the syrup valve and the nozzle; and (g) in which said flush valve actuator includes a discrete flush actuator lever underneath and immediately adjacent to the dispensing valve.

16. The system of claim 15, including a fulcrum secured to a mounting block for the dispensing valve, said lever being pivotally mounted on said fulcrum and said dispensing valve being detachable from the block independent of the flush lever.

17. The system of claim 15, including a trigger on the flush lever, both the flush lever and the dispensing lever being operable by the thumb and a finger of one hand.

18. The system of claim 17, in which the trigger and dispensing actuator include means for moving toward each other as the flush and syrup valves are opened, so that the dispensing valve can be flushed by squeezing the flush lever and dispensing actuator together.

19. A post-mix carbonated beverage dispensing system comprising a. a carbonated beverage dispensing valve having a discrete mounting block and a discrete valve body, said valve body having a nozzle, a normally closed syrup valve, a normally closed water valve, and a dispensing actuator operatively connected to both the syrup and water valves for concurrently opening both the syrup and water valves.

b. said discrete mounting block being securely mounted on and fastened to a carbonated beverage dispensing machine, said valve body and said mounting block jointly having means for locking said body to said block and for selectively releasing said body from said block and for subsequently relocking said body to said block;

c. a syrup line extending from a syrup supply to the nozzle, said syrup line extending through the mounting block and the syrup valve, and a carbonated water line extending from a carbonated water supply to the nozzle, said carbonated water line extending through the mounting block and the water valve;

d. a disconnect valve in each of the carbonated water and syrup lines, said disconnect valves being in said mounting block and having means for being kept open when the valve body is locked to the mounting block;

e. flush connecting means fluidly connected to the carbonated water line upstream of said water disconnect valve and fluidly connected to the syrup line upstream of the syrup disconnect valve and fluidly extending between the carbonated water and syrup lines for fluidly connecting the carbonated water line to the syrup line upstream of both of the carbonated water and syrup dispensing valves, said flush connecting means being mounted directly to and being ported through said mounting block;

f. a normally closed flush valve in said flush connecting means for normally fluidly closing said flush connecting means, said flush valve and said connecting means having pressure neutralizing means for neutralizing syrup pressure upon the flush valve so that normally encountered syrup pressures cannot open said flush valve;

g. a discrete syrup flow control in the syrup line between the syrup valve and the connection of the flush connecting means;

h. a discrete carbonated water flow control in the water line between the nozzle and the connection of the flush connecting means to the carbonated water line;

i. means in said syrup line upstream of the connection of said connecting means to the syrup line for preventing reverse flow of syrup and for preventing upstream flow of flush water in said syrup line; and j. a discrete manually manipulatable mechanical flush valve actuator independently and movably mounted on said valve and operatively connected mechanically and directly to said flush valve for mechanically moving said flush valve to an alternative open position in said flush connecting means, said flush valve being openable concurrently with said syrup valve so that a normal flow of syrup to and through the nozzle is replaced by a flow of carbonated water from upstream of the syrup disconnect valve for flushing all syrup from the syrup disconnect valve, the syrup flow control, the syrup valve, the nozzle, and all that part of the syrup line downstream of the connection of the flush connection means to the syrup line, with said valve body being removable from said mounting block and said flush connecting means after flushing and with the valve body being devoid of syrup, while said syrup and carbonated water lines remain pressurized.

20. The system of claim 19, in which said reverse syrup flow preventing means is a positive displacement syrup pump fluidly in between the connecting means and a remotely located syrup supply.

21. The system of claim 19, in which said syrup pressure neutralizing means comprises an annular valve seat facing a water inlet into the connecting means, an o-ring having its mean diameter sealed upon the valve seat, and a valve stem and syrup seal on the syrup side of the valve seat, the sealed diameter of the valve stem having an effective diameter substantially the same as the mean diameter of the o-ring and the diameter of the valve seat.

22. The system of claim 19, in which said flush connecting means and said flush valve actuator are an exclusively manually manipulatable and actuatable device mounted on said discrete mounting block.

23. The system of claim 22, in which said flush valve is stable only in a closed position, said flush valve being operatively connected to means for biasing the flush valve closed.

24. A carbonated beverage dispensing valve comprising a. a discrete valve body having a nozzle, a carbonated water line, a syrup line, a normally closed carbonated water valve in the water line, a normally closed syrup valve in the syrup line, and a dispensing actuator for opening both the carbonated water and syrup valves concurrently;

b. a discrete valve mounting block to which the valve body is attached, said block having means for mounting the valve to a beverage dispenser, said block and said removable body having lock means for normally locking said body to said block, said body being unlockable and separable from said block while said lines and said block remains pressurized;

c. a disconnect valve in each line, each disconnect valve being in said block;

d. flush connecting means on said block and upstream of the water and syrup disconnect valves and ported through said block into the water and syrup lines for fluidly connecting the water line to the syrup line in the block;

e. a normally closed flush valve in said flush connecting means for normally fluidly closing said connecting means, said flush valve and said flush connecting means having means for neutralizing syrup pressure upon the flush valve so that syrup pressure cannot open the flush valve; and f. a discrete mechanical flushing actuator operatively discrete from said dispensing actuator and discretely mechanically connected at said mounting block to said flush valve for opening the normally closed flush valve for direct fluid connection of the water line to the syrup line.

25. A dispensing valve according to claim 24, in which the connecting means is on an underside of the block.

26. The dispensing valve of claim 24, in which the flush valve actuator is a discrete lever adjacent to the valve body.

27. The dispensing valve of claim 24, in which said neutralizing means comprise (a) an annular valve seat in the connecting means, said valve seat facing against the water line, (b) an elastomeric valve ring having a narrow seal against the valve seat, and (c) means sealing a valve stem on the syrup side of the valve ring and seat, said stem being effectively sealed on a diameter equal to the diameter of the valve seat.

28. The dispensing valve of claim 27, in which the elastomeric ring is an o-ring seated and sealed on its mean diameter.

29. A post-mix carbonated beverage dispensing valve mounting block, comprising a. a block body having means for being fixedly mounted to the exterior of a dispenser, a water port having a water inlet extending from a backside of the block to a water outlet on the front side of the block, and a syrup port having a syrup inlet extending from the block backside to a syrup outlet on the block front side, the water port and syrup port being fluidly discrete from each other;

b. a disconnect valve in each of the outlets, each disconnect valve having means for being opened upon connection and locking of a complementary dispensing valve body to the block;

c. means on the block for locking the valve body to the block;

d. a flushing connector secured to the block and fluidly connected into the water port and into the syrup port fluidly in between respective disconnect valves and the inlets;

e. a mechanical flush valve normally closing the connector;

f. a discrete and dedicated independently and manually operable mechanical flush valve actuator movably mounted and retained on said block and mechanically connected to said flush valve for manually opening the flush valve and fluidly connecting the water port to the syrup port in the mounting block and through the flushing connector; and g. pressure neutralizing means in the connector for neutralizing the syrup pressure upon the flush valve, so that normally encountered syrup pressures cannot open the flush valve in the absence of water pressure.

30. A mounting block according to claim 29, in which the connector is mounted transversely upon the block with respect to the water and syrup ports, said flush valve being likewise transversely mounted and actuatable within the connector.

31. A mounting block according to claim 29, in which said connector is on an underside of the block.

32. A mounting block according to claim 29, including a spring in an upstream side of the connector, said spring biasing the flush valve closed.

33. A mounting block according to claim 29 in which the flush valve actuator includes a push button mechanically connected to said flush valve, said push button being mechanically movable with respect to said block so that the flush valve is mechanically opened in the connector by manual movement of the push button.

* * * * *